US005963183A

United States Patent [19]

Takahashi

[11] Patent Number: 5,963,183

[45] Date of Patent: Oct. 5, 1999

[54] METHOD OF AND APPARATUS FOR DISPLAYING A PLURALITY OF SCREEN MODES

[75] Inventor: Kazunori Takahashi, Kawasaki, Japan

[73] Assignee: Fujitsu Limited, Kawasaki, Japan

[21] Appl. No.: 08/953,681

[22] Filed: Oct. 17, 1997

Related U.S. Application Data

[63] Continuation of application No. 08/570,829, Dec. 12, 1995, abandoned, which is a continuation of application No. 08/111,505, Aug. 25, 1993, abandoned.

[30] Foreign Application Priority Data

Feb. 19, 1993 [JP] Japan ..... 5-30752

[51] Int. Cl.[6] ..... G09G 5/00

[52] U.S. Cl. ..... 345/3; 345/213

[58] Field of Search ..... 345/1, 3, 132, 345/115, 116, 213, 199; 348/511, 521

[56] References Cited

U.S. PATENT DOCUMENTS 4,121,283 10/1978 Walker ..... 345/115
4,684,936 8/1987 Brown et al. ..... 345/116
4,766,427 8/1988 Abe et al. .
4,801,933 1/1989 Yamamoto et al. .
4,825,201 4/1989 Watanabe et al. .
4,897,639 1/1990 Kanayama .
5,111,190 5/1992 Zonda ..... 345/132

*Primary Examiner*—Regina Liang
*Attorney, Agent, or Firm*—Staas & Halsey

[57] ABSTRACT

A method of and an apparatus for displaying a plurality of screen modes. The apparatus includes a synchronizing signal generator for generating a synchronizing signal for one screen mode, a display region correcting device for determining region correction values to display, within an image display region for the one screen mode, an image display region for any one of the plurality of screen modes including the one screen mode, a display region signal generator and a display device. The plurality of screen modes, which are different in resolution from one another, can be displayed in simple structure.

48 Claims, 15 Drawing Sheets

METHOD OF AND APPARATUS FOR DISPLAYING A PLURALITY OF SCREEN MODES

This application is a continuation of application Ser. No. 08/570,829, filed Dec. 12, 1995, now abandoned, which is a continuation of application Ser. No. 08/111,505, filed Aug. 25, 1993, now abandoned.

BACKGROUND OF THE INVENTION

The present invention relates to a method of and an apparatus for displaying a plurality of screen modes wherein image data can be displayed in any one of the screen modes having image display regions different from each other.

In this type of information processing apparatus for displaying images, image data is first temporarily stored in a video memory and the image data read from the video memory is then displayed on a cathode-ray tube (CRT). In this case, the storage capacity of the video memory is relatively small and the data reading speed is also low. Therefore, the image data are displayed on the CRT in a low-resolution screen mode.

While, the video memory has been brought to large storage capacity with the recent rapid advancement in technique and the data reading speed has been highly increased. Thus, there is now an increasing tendency that the image data can be displayed in high resolution.

Further, there has been proposed a multi-scan CRT capable of displaying the image data in the low-resolution screen mode and image data in a high-resolution screen mode.

When image data represented in a format of 640×400 pixels, for example, is displayed on the multi-scan CRT in the low-resolution mode, the following control is executed.

That is, a control program is first executed so that mode information for a horizontal synchronizing frequency of 24 KHz is set to a mode register. Then, a multiplexer changes or sets a pixel clock for reading the pixel data stored in the video memory based on the set 24 KHz mode information to 21 MHz, for example. Further, the control program is executed so as to set synchronizing width information, synchronizing periodic or cyclic information, display start-position information and display completion- or end-position information for a low-resolution screen mode.

A synchronizing signal generator generates a synchronizing signal having a horizontal synchronizing frequency of 24 KHz and a vertical synchronizing frequency of 55 Hz, for example, based on the pixel clock and both the synchronizing width information and the synchronizing cyclic information for the low-resolution screen mode.

Next, a display timing generator generates a display timing signal based on the pixel clock, the synchronizing signal and both the display start-position information and the display end-position information for the low-resolution screen mode. In response to the synchronizing signal and the display timing signal, the multi-scan CRT displays image data in the low-resolution screen mode on a display region of the screen, which is represented in the form or format of 640×400 pixels.

When, on the other hand, the image data in 640×480 pixels is displayed on the multi-scan CRT in the high-resolution screen mode, the following control is executed.

A control program is first executed so as to set mode information for a horizontal synchronizing frequency of 31 KHz, for example, to the mode register. Then, the multiplexer switches or sets the pixel clock to 25 MHz, for example, based on the set 31 KHz mode information. Further, the control program is executed so as to set up synchronizing width information, synchronizing cyclic information, display start-position information and display end-position information for a high-resolution screen mode.

The synchronizing signal generator generates a synchronizing signal having a horizontal synchronizing frequency of 31 KHz and a vertical synchronizing frequency of 60 Hz, for example, based on the pixel clock and both the synchronizing width information and the synchronizing cyclic information for the high-resolution screen mode.

Next, the display timing generator produces a display timing signal based on the pixel clock, the synchronizing signal and both the display start-position information and the display end-position information for the high-resolution screen mode. In response to the synchronizing signal and the display timing signal, the multi-scan CRT displays, in the high-resolution screen mode, image data on a display region of the screen, which is represented in the format of 640×480 pixels.

According to the conventional apparatus, as has been described above, the two kinds of pixel clocks are generated to realize the low-resolution screen mode and the high-resolution screen mode. Further, the synchronizing signals and the display timing signals are separately produced in accordance with their corresponding pixel clocks. Therefore, the apparatus is rendered complex in structure and high in cost.

SUMMARY OF THE INVENTION

The present invention has been made to solve such a problem. Therefore, the object of the present invention is to provide a method of and an apparatus for displaying a plurality of screen modes, wherein the plurality of screen modes different in resolution from each other can be displayed in simple structure.

The apparatus according to the present invention comprises a synchronizing signal generator 14, a display region correcting device 16, a display region signal generator 18 and a display device 28 as illustrated in FIG. 1.

The synchronizing signal generator 14 generates a synchronizing signal for one screen mode.

The display region correcting device 16 determines region correction values for displaying, within an image display region for the one screen mode, an image display region for any one of a plurality of screen modes including the one screen mode. The display region signal generator 18 is electrically connected to the synchronizing signal generator 14 and the display region correcting device 16.

The display region signal generator generates a display region signal for the image display region corresponding to the any one of screen modes based on the region correction values and the synchronizing signal for the one screen mode.

The display device 28 is of a CRT, for example, and displays the plurality of screen modes including the one screen mode on the screen in one screen mode based on the synchronizing signal and the display region signal.

A method of displaying a plurality of screen modes, according to the present invention includes a synchronizing signal generating step, a display region correcting step, a display region signal generating step and a displaying step.

In the synchronizing signal generating step, a synchronizing signal for one screen mode is generated.

In the display region correcting step, region correction values are determined to display, within an image display region for the one screen mode, an image display region for any one of the plurality of screen modes including the one screen mode.

In the display region signal generating step, a display region signal for the image display region corresponding to the any one of screen modes is generated based on the region correction values and the synchronizing signal for the one screen mode.

In the displaying step, the plurality of screen modes including the one screen mode are displayed on the screen in one screen mode based on the synchronizing signal and the display region signal.

Here, examples of the display device may include a cathode-ray tube for a high-resolution screen mode, etc.

There may also be provided a pixel signal generator for generating a pixel signal for each of pixels which form the image display region for the screen mode. In this case, the display region signal generator can generate a display region signal for the image display region corresponding to the any one of screen modes based on the region correction values, the synchronizing signal for the one screen mode and the pixel signal.

The synchronizing signal generator generates a horizontal synchronizing signal and a vertical synchronizing signal for one screen mode. The synchronizing signal generator may comprise a counting device, a comparator and a signal generating device. The counting device counts the number of pulses of a clock corresponding to each pixel signal. The comparator compares the count of the counting device with each of a synchronizing width and a synchronizing period or cycle which have been determined in advance. The signal generating device generates the synchronizing signal based on the output of the comparator.

The display region correcting device may include a screen mode setter, a correction value storage and a correction value selector. The screen mode setter sets any one of the plurality of screen modes including the one screen mode. The correction value storage stores the region correction values every plural screen modes. The correction value selector selects a region correction value corresponding to the screen mode set by the screen mode setter from the region correction values stored in the correction value storage.

Here, examples of the correction value storage may include a register, various memories, etc. As the screen mode setter may be mentioned a register or the like. Any of the screen modes is set up based on a control program or the like. Examples of the correction value selector may include a multiplexer, a changeover switch, etc.

Further, the correction value storage may store, as the region correction values, a difference between display start and end positions for displaying the image display region for the one screen mode and a difference between display start and end positions for displaying the image display region for any one of the screen modes.

The display region signal generator has a counting device, a comparator and a signal generating device. The counting device starts the counting of the number of pulses of a clock corresponding to each pixel signal from or on the basis of the region correction values. The comparator compares the count of the counting device with each of display start-position information and display end-position information for displaying the image display region for the one screen mode. The signal generating device generates the display region signal based on the output of the comparator.

Here, the display start-position information and the display end-position information may be stored in a register or the like in advance. Examples of the counting device may include a counter, etc.

The display region signal generator comprises a counting device, an adder, a comparator and a signal generating device. The counting device starts the counting of the number of pulses of a clock corresponding to each pixel signal. The adder adds each of the region correction values sent from the display region correcting device to the count of the counting device. The comparator compares the value obtained by the adder with each of the display start-position information and the display end-position information for displaying the image display region for the one screen mode. The signal generating device generates the display region signal based on the output of the comparator.

The display region signal generator comprises a counting device, a subtracter, a comparator and a signal generating device. The counting device starts the counting of the number of pulses of a clock corresponding to each pixel signal. The subtracter subtracts each of the region correction values from each of the display start-position information and the display end-position information for displaying the image display region for the any one of screen modes. The comparator compares the output of the subtracter with the count of the counting device. The signal generating device generates the display region signal based on the output of the comparator.

It is preferable that the one screen mode represents a high-resolution screen mode and each of the plural screen modes other than the one screen mode represents a low-resolution screen mode.

According to the present invention, the synchronizing signal for the one screen mode is generated in the synchronizing signal generating step 101. In the display region correcting step 102, the region correction values are determined to display the image display region for any one of the plurality of screen modes including the one screen mode, within the image display region for the one screen mode.

Next, the display region signal for the image display region corresponding to any one of the screen modes is generated based on the region correction values and the synchronizing signal for the one screen mode in the display region signal generating step 103.

Further, the plural screen modes including the one screen mode are displayed on the screen in one screen mode based on the synchronizing signal and the display region signal in the displaying step 104.

That is, since the plural screen modes can be displayed on the displaying means in one screen mode, the circuit configuration of the apparatus is simplified and the apparatus can be offered at low cost.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

A method of and an apparatus for displaying a plurality of screen modes according to the present invention will hereinafter be described specifically by the following examples.

[First Embodiment]

Figure 1:
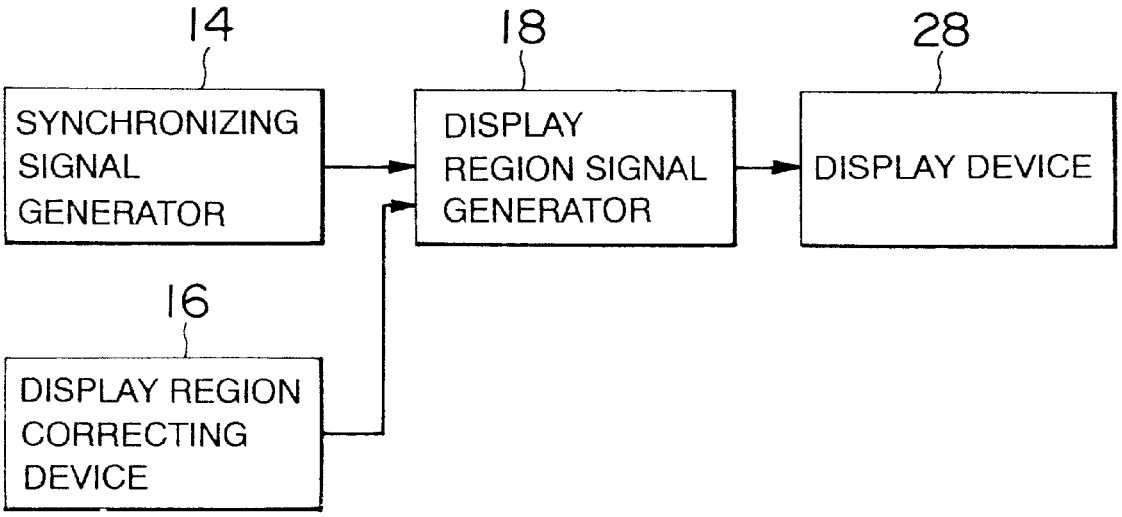
FIG. 1 is a block diagram showing an apparatus for displaying a plurality of screen modes, which describes a summary of the present invention.
Figure 2:
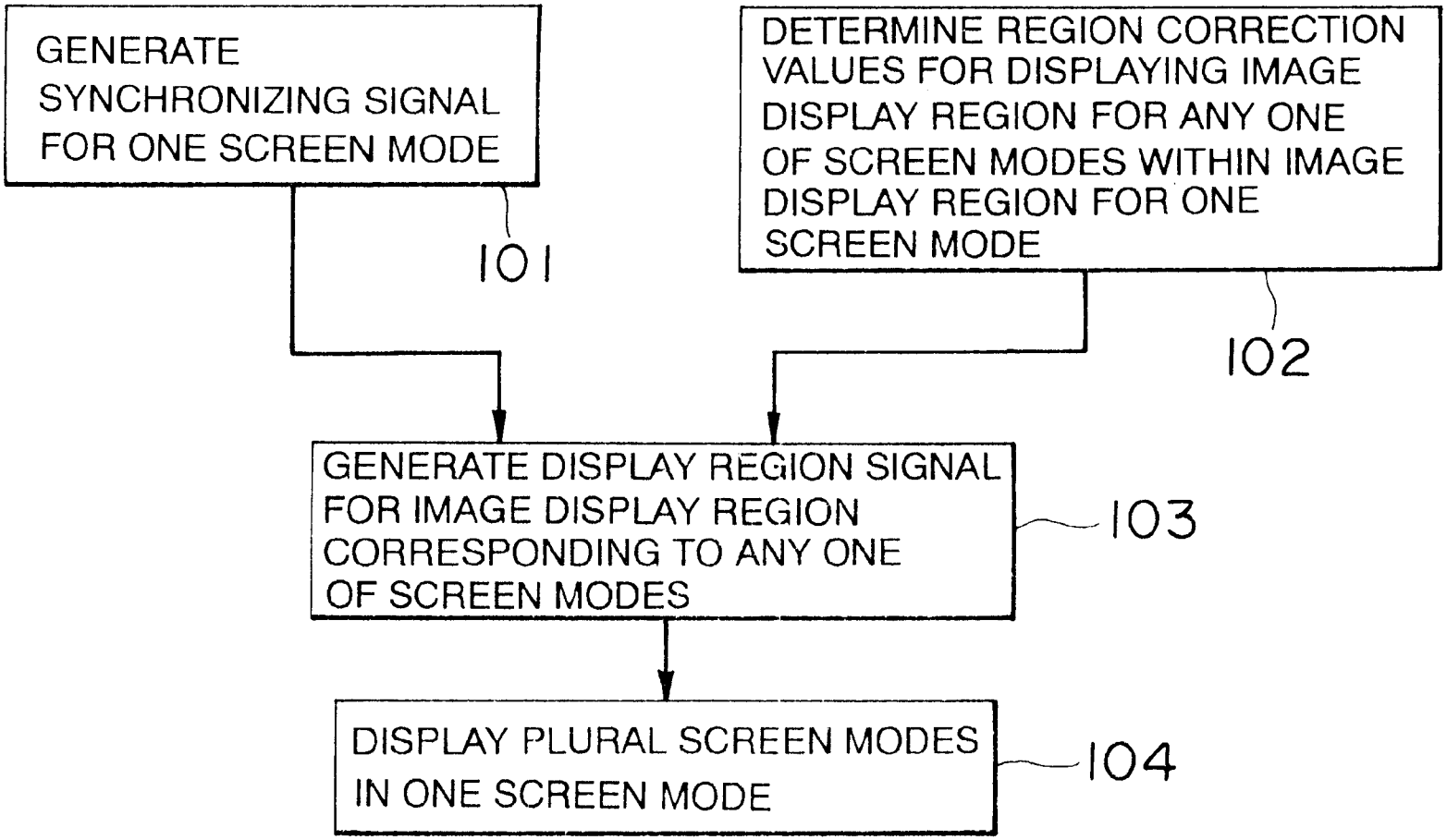
FIG. 2 is a flowchart for describing a method of displaying a plurality of screen modes, which shows a summary of the present invention.
Figure 3:
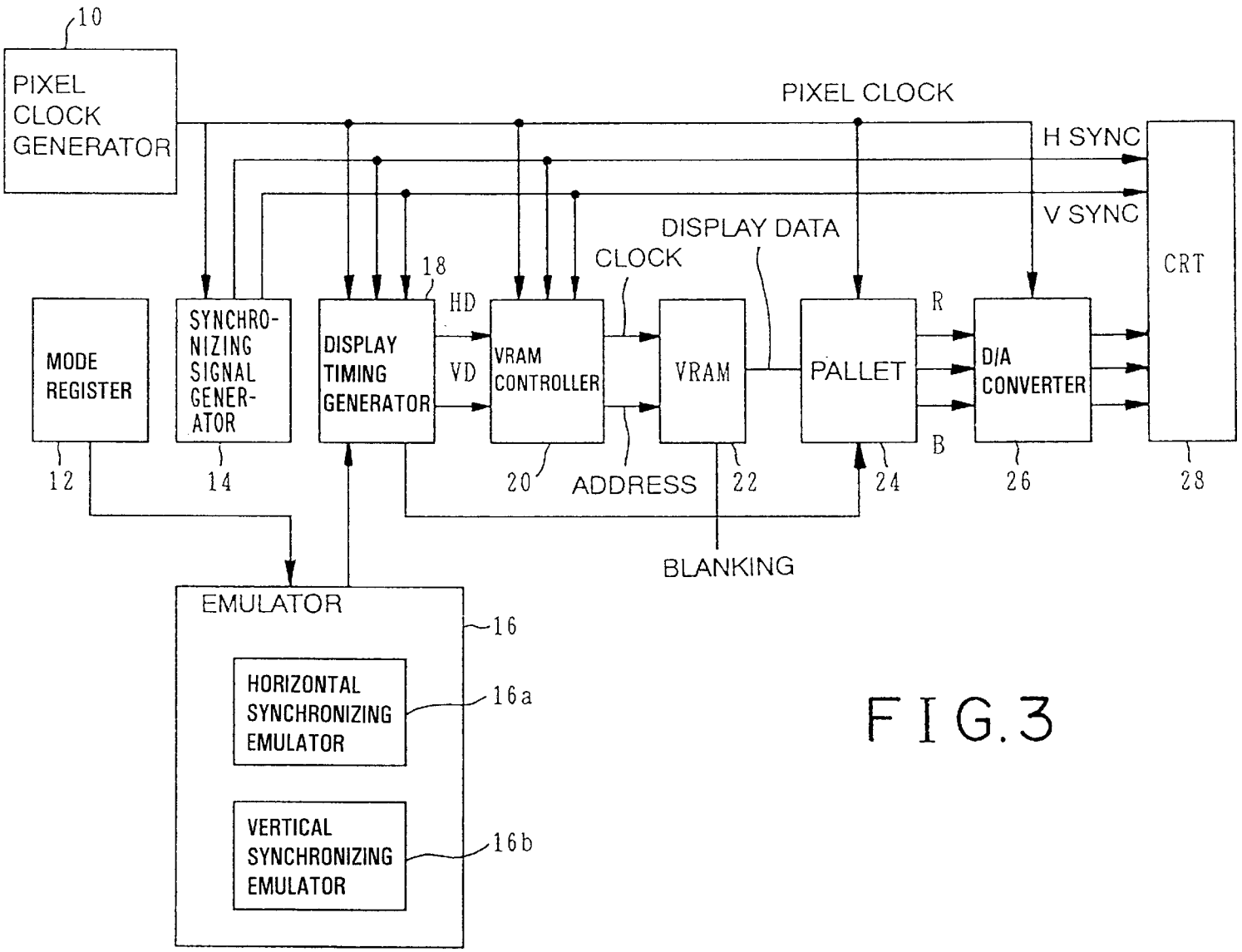
FIG. 3 is a block diagram showing an apparatus for displaying a plurality of screen modes, according to a first embodiment of the present invention.

FIG. 3 is block diagram showing a plural screen-modes displaying apparatus according to a first embodiment of the present invention, for effecting a method of displaying a plurality of screen modes. In the present embodiment, one screen mode will be described as a high-resolution screen mode M2.

The plural screen-modes displaying apparatus can display image data on the screen in the high-resolution screen mode M2 and display it even in a low-resolution screen mode M1.

A pixel clock generator 10 generates a pixel clock used for each of pixels which form an image display region in the high-resolution screen mode M2.

A mode register 12 stores therein screen mode information set up in accordance with a control program (not shown). The mode register 12 stores therein information about either one of the low-resolution screen mode M1 (e.g., a horizontal synchronizing frequency of 24 KHz) and the high-resolution screen mode M2 (e.g., a horizontal synchronizing frequency of 31 KHz).

A synchronizing signal generator 14 is electrically connected to the pixel clock generator 10. The synchronizing signal generator 14 generates a horizontal synchronizing signal (H-SYNC) and a vertical synchronizing signal (V-SYNC) for the high-resolution screen mode M2 based on a pixel clock produced from the pixel clock generator 10 and outputs both synchronizing signals to a CRT 28.

Figure 4:
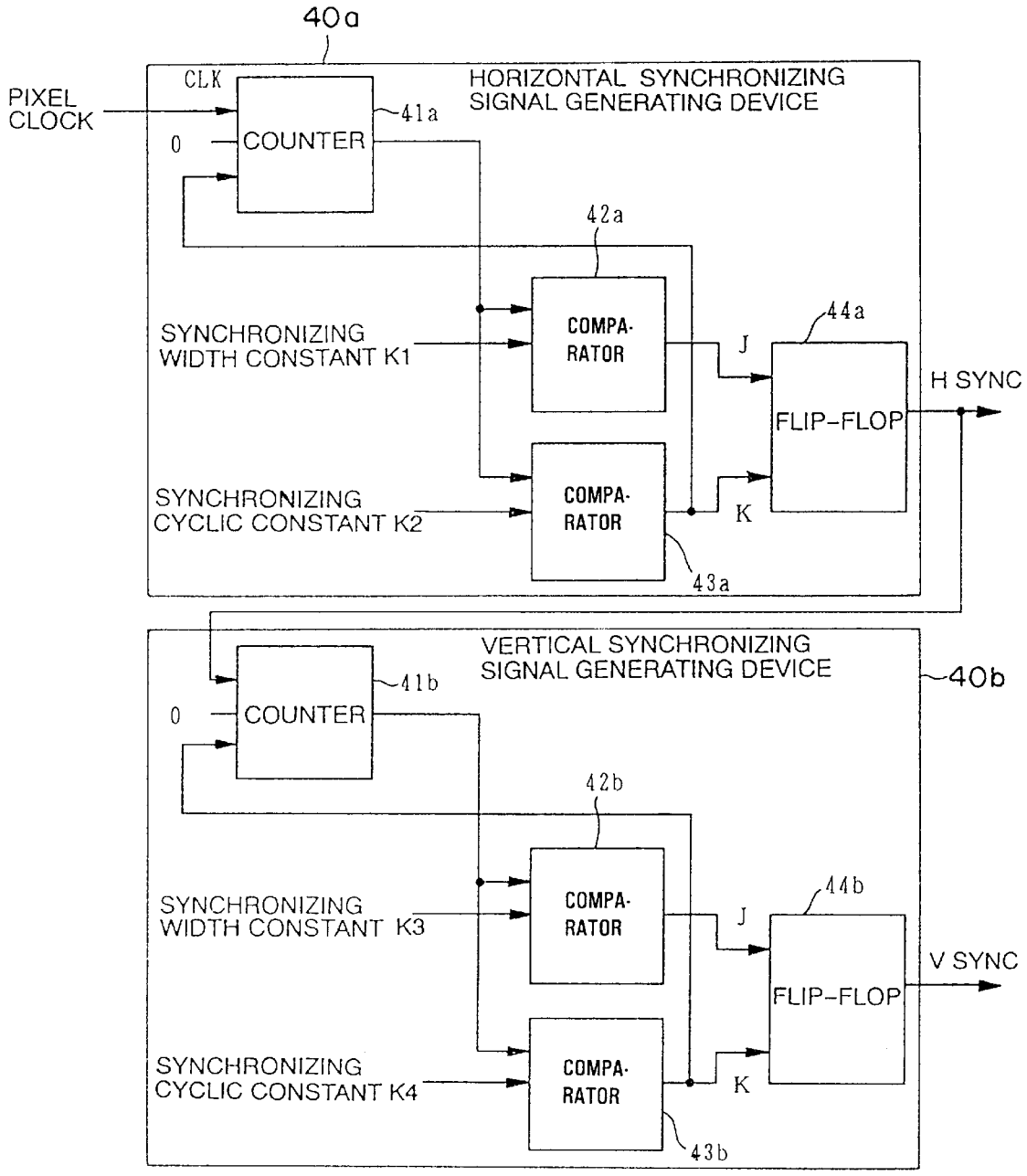
FIG. 4 is a block diagram showing a synchronizing signal generator employed in the apparatus according to the first embodiment of the present invention.

FIG. 4 is a block diagram illustrating the synchronizing signal generator employed in the first embodiment. As shown in FIG. 4, the synchronizing signal generator 14 comprises a horizontal synchronizing signal generating device 40*a* and a vertical synchronizing signal generating device 40*b*.

The horizontal synchronizing signal generating device 40*a* has a counter 41*a*, comparators 42*a* and 43*a* and a flip-flop (FF) 44*a*.

The counter 41*a* counts the number of pulses of a pixel clock CLK1 generated from the pixel clock generator 10. The comparators 42*a* and 43*a* are electrically connected to the output of the counter 41*a*.

The comparator 42*a* compares a given or predetermined synchronizing width constant K1 for setting a synchronizing width of a horizontal synchronizing signal with the count of the number of the clocks, which is sent from the counter 41*a*. If the count is equal to the predetermined synchronizing width constant K1, then the comparator 42*a* sets a J terminal of the flip-flop 44*a*.

The comparator 43*a* compares a given or predetermined synchronizing periodic or cyclic constant K2 for setting a synchronizing period or cycle of a horizontal synchronizing signal with the count of the number of the clocks, which is sent from the counter 41*a*. If the count is equal to the predetermined synchronizing cyclic constant K2, then the comparator 43*a* resets a K terminal of the flip-flop 44*a* and loads the counter 41*a*.

The flip-flop 44*a* generates a horizontal synchronizing signal in accordance with the setting of the J terminal of the flip-flop 44*a* by the comparator 42*a* and the resetting of the K terminal thereof by the comparator 43*a*.

The vertical synchronizing signal generating device 40*b* has a counter 41*b*, comparators 42*b* and 43*b* and a flip-flop 44*b*.

The flip-flop 44*a* is electrically connected with the counter 41*b*, which in turn counts the number of horizontal synchronizing signals or pulses output from the flip-flop 44*a*. The comparators 42*b* and 43*b* are electrically connected to the output of the counter 41*b*.

The comparator 42*b* compares a given or predetermined synchronizing width constant K3 for setting a synchronizing width of a vertical synchronizing signal with the count sent from the counter 41*b*. If they are equal to each other, then the comparator 42*b* sets a J terminal of the flip-flop 44*b*.

The comparator 43*b* compares a given or predetermined synchronizing periodic or cyclic constant K4 for setting a synchronizing period or cycle of the vertical synchronizing signal with the count sent from the counter 41*b*. If they are equal to each other, then the comparator 43*b* resets a K terminal of the flip-flop 44*b* and loads the counter 41*b*.

The flip-flop 44*b* generates a vertical synchronizing signal in accordance with the setting of the J terminal of the flip-flop 44*b* by the comparator 42*b* and the resetting of the K terminal thereof by the comparator 43*b*.

Referring back to FIG. 3, the emulator 16 is electrically connected to the mode register 12 as a region correcting means. The emulator 16 sets up region correction values to display, within an image display region for the high-resolution screen mode M2, an image display region for the low-resolution screen mode M1 and an image display region for the high-resolution screen mode M2. The emulator 16 comprises a horizontal synchronizing emulator 16*a* and a vertical synchronizing emulator 16*b*.

Figure 5:
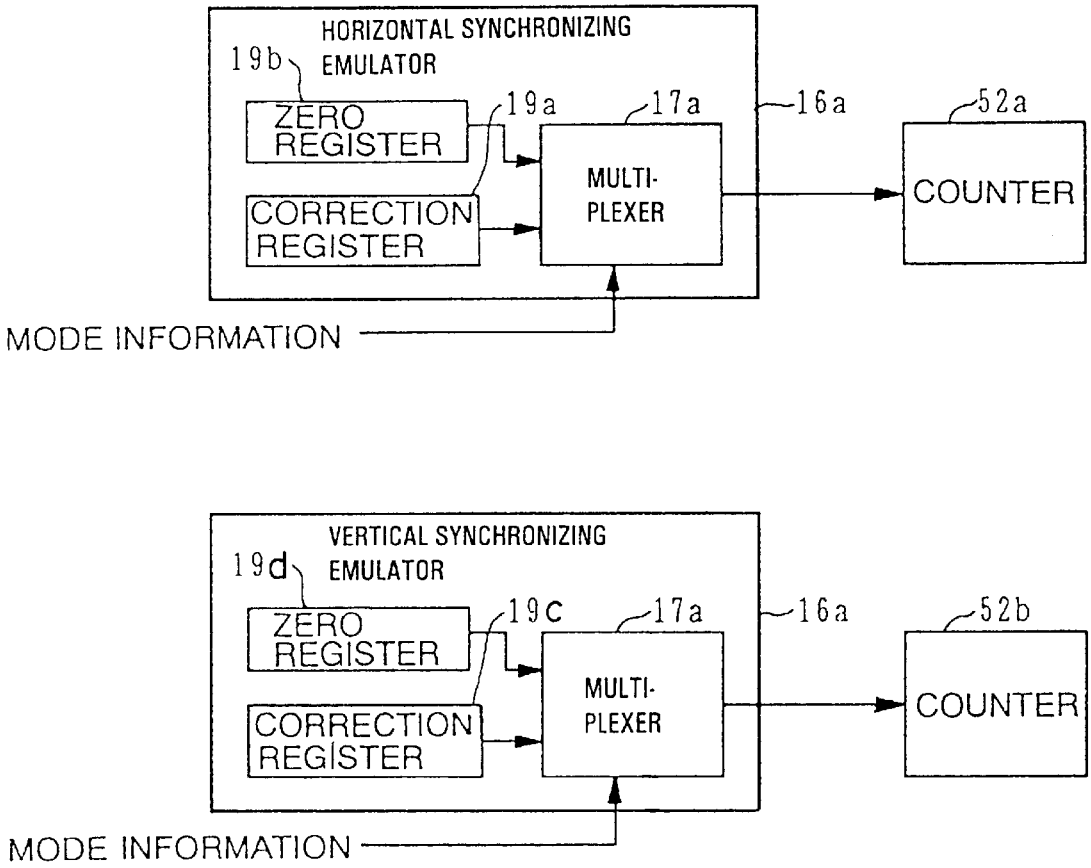
FIG. 5 is a block diagram illustrating an emulator employed in the apparatus shown in FIG. 3.

FIG. 5 is a block diagram illustrating one example of the emulator employed in the first embodiment. As shown in FIG. 5, the horizontal synchronizing emulator 16*a* has a correction register 19*a*, a zero register 19*b* and a multiplexer 17*a*.

The correction register 19*a* stores therein a difference in value between a horizontal synchronizing signal for the high-resolution screen mode M2 and a horizontal synchronizing signal for the low-resolution screen mode M1 as a horizontal correction value with respect to the horizontal synchronizing signal for the low-resolution screen mode M1. The zero register 19*b* stores therein a zero value as a horizontal correction value with respect to the horizontal synchronizing signal for the high-resolution screen mode M2. The multiplexer 17*a* selects either one of the correction register 19*a* and the zero register 19*b* in response to screen mode information output from the mode register 12. In response to the screen mode information, the multiplexer 17*a* also selects either one of a horizontal correction value 0 for the high-resolution screen mode M2, which has been stored in the zero register l9*b* and a horizontal correction value 12, for the low-resolution screen mode M1, which has been stored in the correction register 19*a*.

The vertical synchronizing emulator 16*b* has a correction register 19*c*, a zero register 19*d* and a multiplexer 17*b*.

The correction register 19*c* stores therein a difference in value between a vertical synchronizing signal for the high-resolution screen mode M2 and a vertical synchronizing signal for the low-resolution screen mode M1 as a vertical correction value with respect to the vertical synchronizing signal for the low-resolution screen mode M1.

The zero register 19*d* stores therein a zero value as a vertical correction value with respect to the vertical synchronizing signal for the high-resolution screen mode M2. The multiplexer 17*b* selects either one of the correction register 19*c* and the zero register 19*d* in response to the screen mode information output from the mode register 12.

Referring to FIG. 3, the display timing generator 18 is electrically connected to the emulator 16. The display timing generator 18 generates a display timing signal for an image display region corresponding to the screen mode information on the basis of the horizontal and vertical correction values with respect to the horizontal and vertical synchronizing signals for the high-resolution screen mode M2 and the pixel clock.

Figure 6:
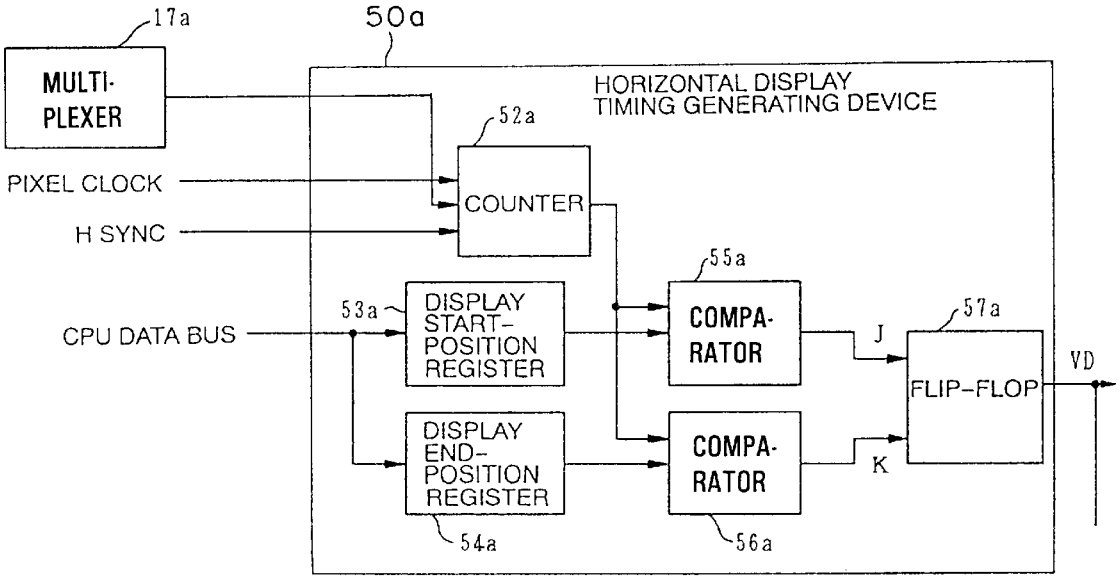
FIG. 6 is a block diagram depicting a display timing generator employed in the apparatus shown in FIG. 3.
Figure 6:
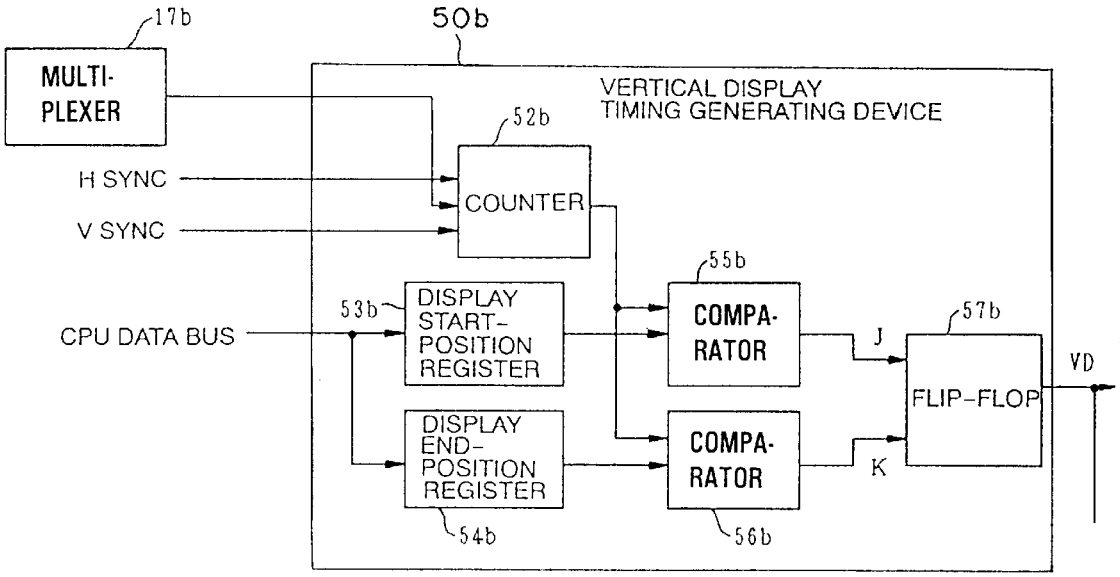

FIG. 6 is a block diagram showing a display timing generator employed in the first embodiment. As illustrated in FIG. 6, a horizontal display timing generating device 50*a* comprises a counter 52*a*, a display start-position register 53*a*, a display completion-position or end-position register 54*a*, comparators 55*a* and 56*a* and a flip-flop 57*a*.

The multiplexer 17*a* is electrically connected with the counter 52*a*. The counter 52*a* starts to count the number of pulses of the pixel clock from the values stored in the registers, which are output from the multiplexer 17*a*.

The display start-position register 53*a* is electrically connected to an unillustrated CPU data bus and stores therein horizontal display start-position information for the image display region corresponding to the high-resolution screen mode M2. The display end-position register 54*a* is electrically connected to the CPU data bus and stores therein display end position information for the image display region corresponding to the high-resolution screen mode M2.

The comparator 55*a* is electrically connected to the counter 52*a* and the display start-position register 53*a*. The comparator 55*a* compares the count sent from the counter 52*a* with the display start-position information output from the display start-position register 53*a*. If they are equal to each other, then the comparator 55*a* sets a J terminal of the flip-flop 57*a*.

The comparator 56*a* is electrically connected to the counter 52*a* and the display end-position register 54*a*. The comparator 56*a* compares the count supplied from the counter 52*a* with the display end-position information sent from the display end-position register 54*a*. If they are equal to each other, then the comparator 56*a* resets a K terminal of the flip-flop 57*a*.

As shown in FIG. 6, a vertical display timing generating device 50*b* comprises a counter 52*b*, a display start-position register 53*b*, a display end position register 54*b*, comparators 55*b* and 56*b* and a flip-flop 57*b*.

The multiplexer 17*b* is electrically connected with the counter 52*b*. The counter 52*b* starts to count the number of pulses of the horizontal synchronizing signal from or on the basis of the values stored in the registers, which are output from the multiplexer 17*b*.

The display start-position register 53*b* is electrically connected to a CPU data bus and stores therein vertical display start-position information for the image display region corresponding to the high-resolution screen mode M2. The display end-position register 54*b* is electrically connected to the CPU data bus and stores therein vertical display end-position information for the image display region corresponding to the high-resolution screen mode M2.

The comparator 55*b* is electrically connected to the counter 52*b* and the display start-position register 53*b*. The comparator 55*b* compares the count sent from the counter 52*b* with the vertical display start-position information output from the display start-position register 53*b*. If they are equal to each other, then the comparator 55*b* sets a J terminal of the flip-flop 57*b*.

The comparator 56*b* is electrically connected to the counter 52*b* and the display end-position register 54*b*. The comparator 56*b* compares the count supplied from the counter 52*b* with the display end-position information sent from the display end-position register 54*b*. If they are equal to each other, then the comparator 56*b* resets a K terminal of the flip-flop 57*b*.

A VRAM controller 20 is electrically connected to the display timing generator 18. The VRAM controller 20 produces a transfer clock and an address so as to be output to a VRAM 22.

Under the control of the VRAM controller 20, the VRAM 22 stores therein image data to be displayed and outputs the image data to a pallet 24. The pallet 24 effects coloring processing on the image data to be displayed and outputs R, G and B signals obtained by effecting gradation or tonal processing on the image data to be displayed to a D/A converter 26.

The D/A converter 26 converts a digital signal supplied from the pallet 24 into an analog signal adapted to the CRT 28.

First Embodiment

Figure 9:
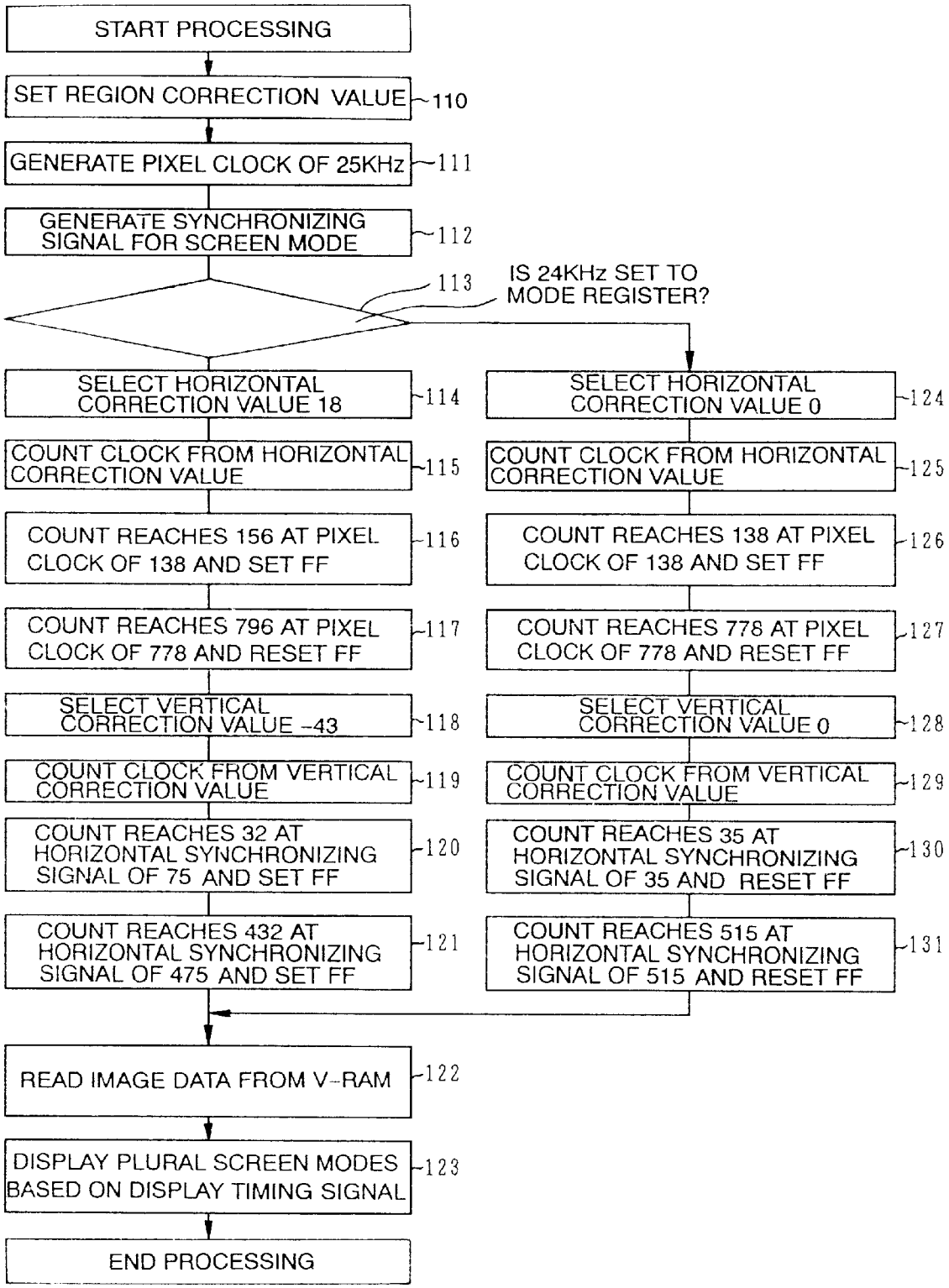
FIG. 9 is a flowchart for describing a method of displaying a plurality of screen modes, according to a second embodiment of the present invention.

FIG. 9 is a flowchart for explaining a method of displaying a plurality of screen modes, according to the first embodiment. Processes for effecting the method according to the first embodiment will next be described with reference to FIG. 9. In the present embodiment, one screen mode will be defined as a high-resolution screen mode and each of other screen modes will be defined as a low-resolution screen mode.

In the high-resolution screen mode, a pixel clock, a horizontal synchronizing frequency, a vertical synchronizing frequency and an image display region are respectively represented as 25 MHz, 31 KHz, 60 Hz and 640×480 pixels. An image display region for the low-resolution screen mode is represented in the form of 640×400 pixels.

First of all, the horizontal synchronizing emulator 16*a* sets a horizontal correction value 0 with respect to the horizontal synchronizing frequency of 31 KHz for the high-resolution screen mode to the zero register 19*b*. Then, the horizontal synchronizing emulator 16*a* sets a horizontal correction value −18 with respect to a horizontal synchronizing frequency of 24 KHz for the low-resolution screen mode to the correction register 19*a*. Further, the vertical synchronizing emulator 16*b* sets a vertical correction value 0 with respect to the vertical synchronizing frequency for the high-resolution screen mode to the zero register 19*d*. The vertical synchronizing emulator 16*b* also sets a vertical correction value 43 with respect to the vertical synchronizing frequency for the low-resolution screen mode to the correction register 19*c* (Step 110).

Next, the pixel clock generator 10 generates the pixel clock of 25 MHz for the high-resolution screen mode to read respective pixel data from the image data stored in the VRAM 22 (Step 111).

The counter 41*a* in the horizontal synchronizing signal generating device 40*a* then starts to count the number of pulses of the pixel clock. The comparators 42*a* and 43*a* compare the count of the counter 41*a* with the predetermined synchronizing width information K1 and the predetermined synchronizing cyclic information K2 respectively. If the count reaches the synchronizing width information K1, then the J terminal of the flip-flop 44*a* is set. Further, if the count is brought to the synchronizing cyclic information K2, then the K terminal of the flip-flop 44*a* is reset. Thus, the flip-flop 44*a* produces the horizontal synchronizing signal of 31 KHz for the high-resolution screen mode.

Further, the counter 41*b* in the synchronizing signal generating device 40*b* counts the number of pulses of the horizontal synchronizing signal supplied from the flip-flop 44*a*. Thereafter, the comparators 42*b* and 43*b* compare the count of the counter 41*b* with the predetermined synchronizing width information K3 and the predetermined synchronizing cyclic information K4 respectively. If the count reaches the synchronizing width information K3, then the J terminal of the flip-flop 44*b* is set. Further, if the count reaches the predetermined synchronizing cyclic information K4, then the K terminal of the flip-flop 44*b* is reset. Thus, the flip-flop 44*b* generates the vertical synchronizing signal of 60 Hz for the high-resolution screen mode (Step 112).

Next, the emulator 16 makes a decision as to whether or not either one of the low-resolution screen mode information and the high-resolution screen mode information has been set to the mode register 12 based on the control program (not shown) (Step 113).

If the low-resolution screen mode information is set to the mode register 12, then the multiplexer 17*a* selects a horizontal correction value 18 with respect to the horizontal synchronizing signal of 24 KHz for the low-resolution screen mode from the correction register 19*a* in response to the low-resolution screen mode information (Step 114). The counter 52*a* starts to count the number of pulses of the pixel clock from the horizontal correction value 18 supplied from the multiplexer 17*a* (Step 115).

If the number of the pulses of the pixel clock reaches horizontal display start-position information 138 for the high-resolution screen mode, then the count of the counter 52*a* is brought to 156. At this time, the count reaches horizontal display start-position information 138 for the low-resolution screen mode, which has been stored in the display start-position register 53*a*, and the comparator 55*a* sets the J terminal of the flip-flop 57*a* (Step 116).

Next, if the number of the pulses of the pixel clock reaches horizontal display end-position information 778 for the high-resolution screen mode, then the count of the counter 52*a* becomes 796. At this time, the count reaches horizontal display end-position information 796 for the low-resolution screen mode, which has been stored in the display end-position register 54*a*. Further, the comparator 56*a* resets the K terminal of the flip-flop 57*a* so as to produce a horizontal display timing signal from the flip-flop 57*a* (Step 117).

Further, the multiplexer 17*b* selects a vertical correction value −43 for the 24 KHz mode from the correction register 19*c* in response to the low-resolution screen mode information 24 KHz (Step 118). The counter 52*b* starts counting the number of pulses of the pixel clock from or on the basis of the vertical correction value −43 sent from the multiplexer 17*b* (Step 119).

If the number of the pulses of the horizontal synchronizing signal reaches vertical display start-position information 75 for the high-resolution screen mode, then the count of the counter 52*b* is brought to 32. At this time, the count reaches vertical display start-position information 32 for the low-resolution screen mode, which has been stored in the display start-position register 53*b*, and the comparator 55*b* sets the J terminal of the flip-flop 57*b* (Step 120).

Next, if the number of the pulses of the horizontal synchronizing signal reaches vertical display end-position information 475 for the high-resolution screen mode, then the count of the counter 52*b* becomes 432. At this time, the count reaches vertical display end-position information 432 for the low-resolution screen mode, which has been stored in the display end-position register 54*b*. Further, the comparator 56*b* resets the K terminal of the flip-flop 57*b* so that a vertical display timing signal is generated from the flip-flop 57*b* (Step 121).

Figure 7:
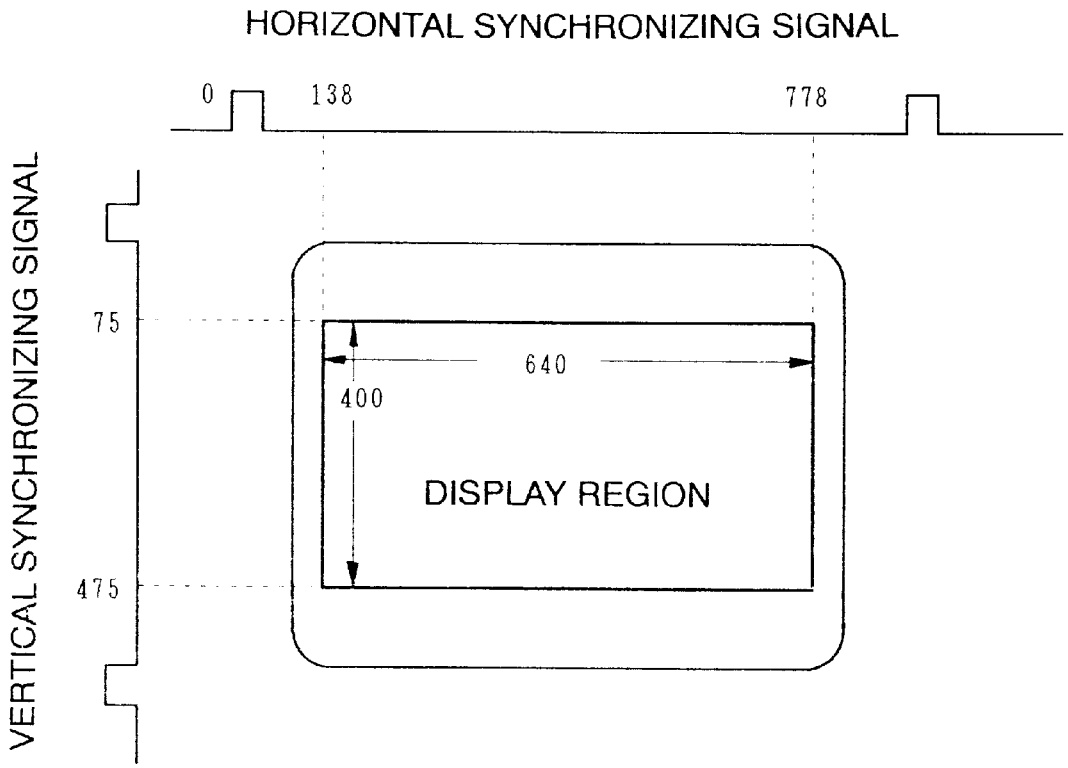
FIG. 7 is a view for describing the emulation of a screen mode M1 based on a screen mode M2.

The emulation of 24 KHz for the low-resolution screen mode by 31 KHz for the high-resolution screen mode is shown in FIG. 7. Here, the image display region for the low-resolution screen mode is represented in the form of 640×400 pixels.

Further, the VRAM controller 20 reads image data to be displayed from the VRAM 22 based on the horizontal display timing signal and the vertical display timing signal (Step 122). Thereafter, the pallet 24 effects coloring processing on the read image data. The D/A converter 26 converts the so-processed image data into an analog signal so as to be displayed on the CRT 28 (Step 123).

If, on the other hand, the high-resolution screen mode represented by 31 KHz is selected in Step 113, then the multiplexer 17*a* selects the horizontal correction value (zero value) stored in the zero register 19*b* (Step 124). In this case, the counter 52*a* counts the pixel clock from the zero value (Step 125). Therefore, when the pixel clock pulse assumes 138, the count is brought to 138 so as to set the FF (Step 126). When, on the other hand, the pixel clock pulse takes 778, the count is brought to 778 so as to reset the FF (Step 127).

Further, the multiplexer 17*b* selects the vertical correction value (zero value) stored in the zero register 19*d* (Step 128). The counter 52*b* counts the pixel clock from the zero value (Step 129). Therefore, when the horizontal synchronizing signal takes 35, the count is brought to 35 so as to set the FF (Step 130). When, on the other hand, the horizontal synchronizing signal takes 515, the count is brought to 515 so as to reset the FF (Step 131). Further, the routine proceeds to Step 122, after which a process of Step 123 is executed.

Figure 8:
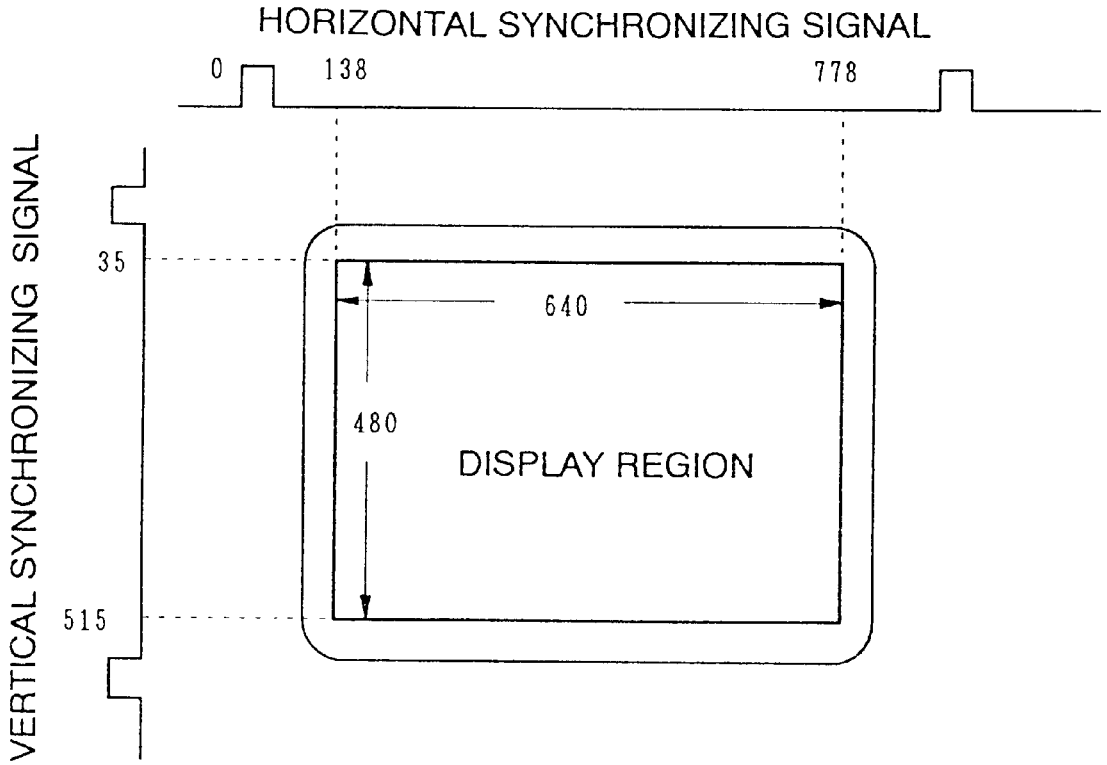
FIG. 8 is a view for describing timing chart for the screen mode M2 (31 KHz)

As shown in FIG. 8, the image data is displayed on the display region represented in the format of 640×480 pixels under the high-resolution screen mode represented by 31 KHz.

According to the first embodiment, as described above, the image data in the high-resolution screen mode and the image data in the low-resolution screen mode can be displayed within the screen display region for the high-resolution screen mode. It is therefore possible to provide an apparatus for displaying a plurality of screen modes, which is simple in control and low in cost.

Second Embodiment

Figure 10:
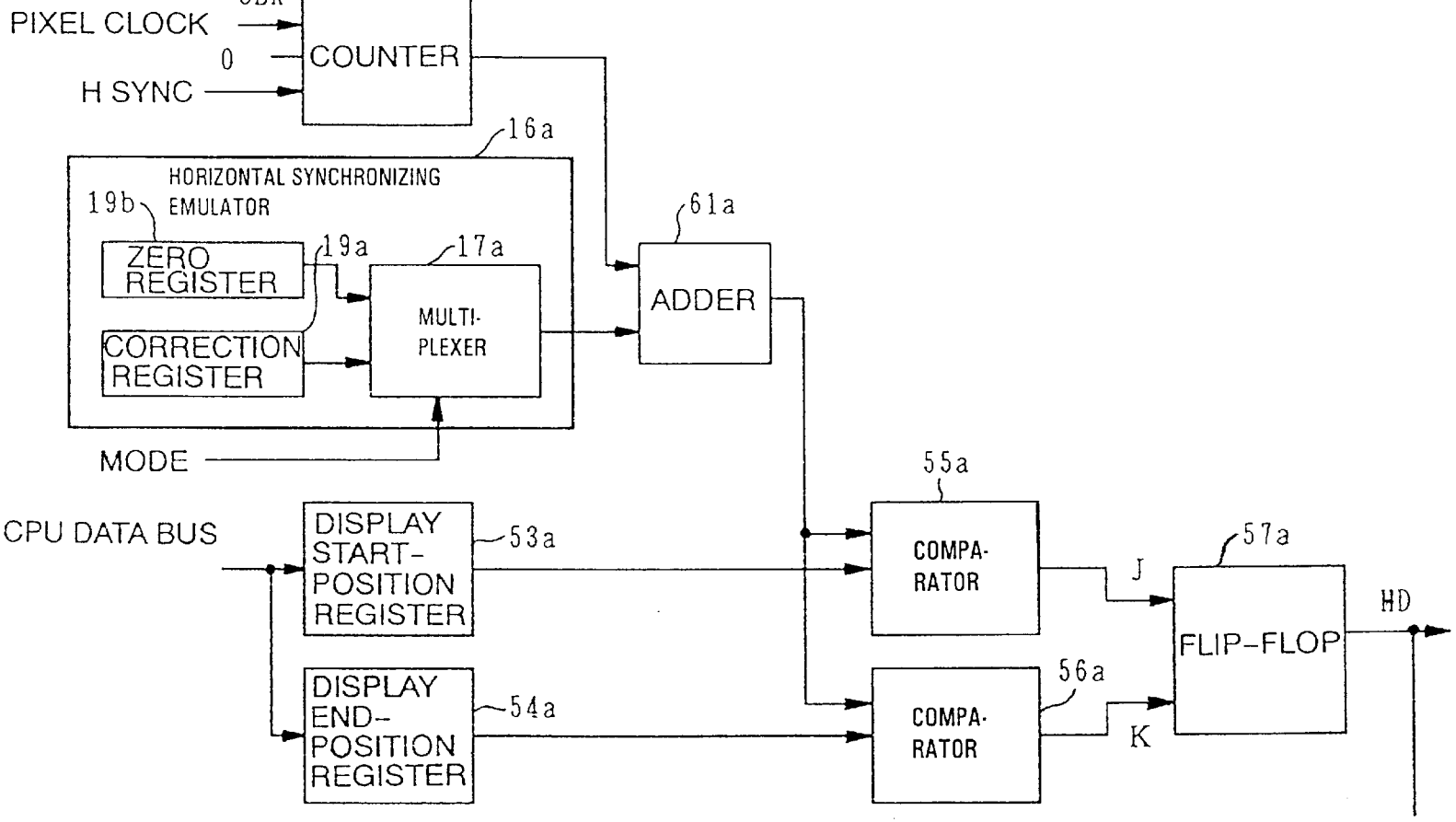
FIG. 10 is a block diagram illustrating a horizontal synchronizing emulator and a horizontal display timing generating device both used for the execution of the method according to the second embodiment of the present invention.
Figure 11:
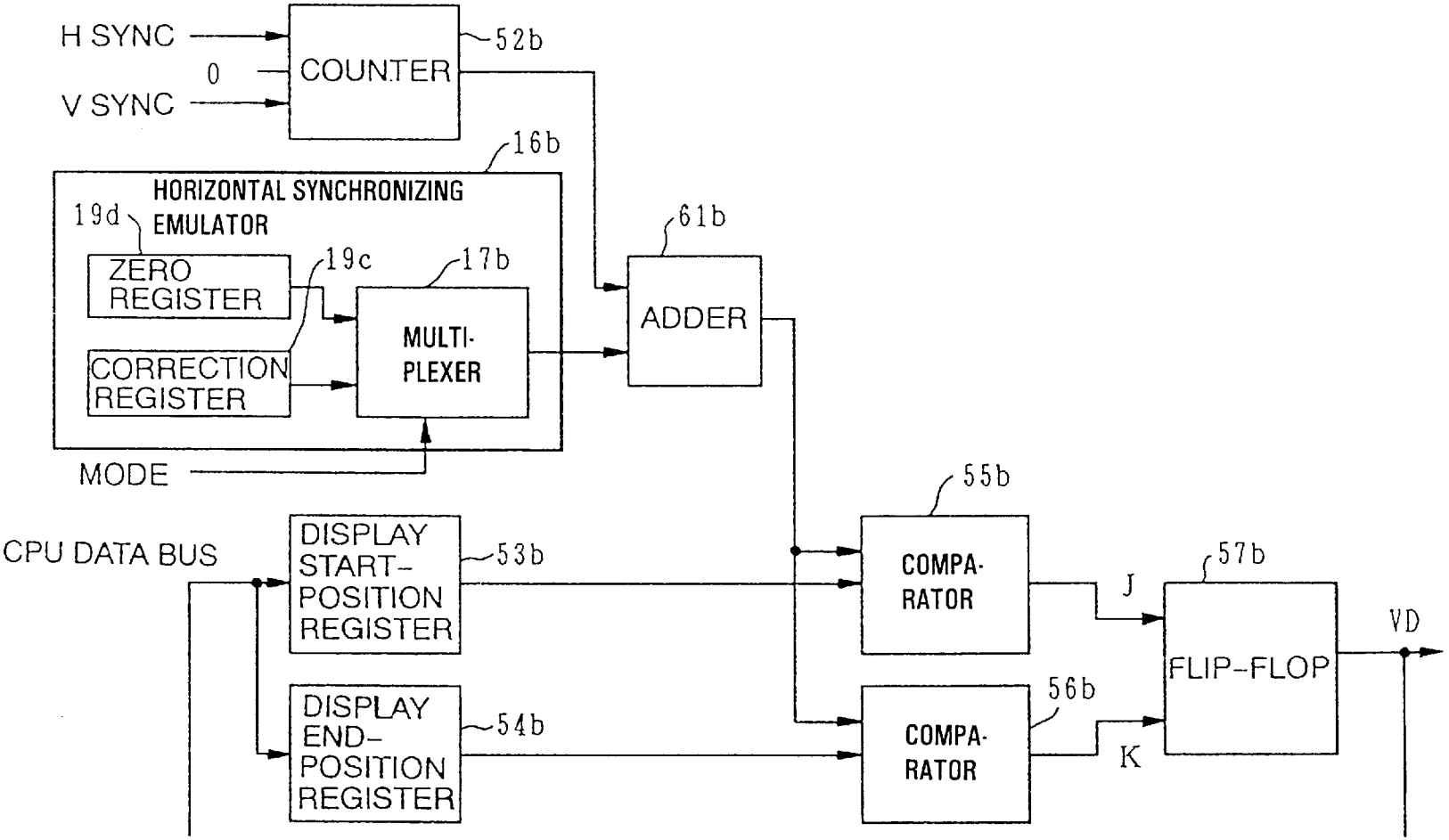
FIG. 11 is a block diagram showing a vertical synchronizing emulator and a vertical display timing generating device both used for the execution of the method according to the second embodiment of the present invention.

A description will next be made of the second embodiment of the present invention. The second embodiment differs from the first embodiment in that each display timing generator is different in structure from that employed in the first embodiment. FIG. 10 is a block diagram showing a horizontal synchronizing emulator and a horizontal display timing generating device both employed in the second embodiment. FIG. 11 is a block diagram illustrating a vertical synchronizing emulator and a vertical display timing generating device both employed in the second embodiment. The display timing generating devices have ladders 61*a* and 61*b* respectively.

The adder 61*a* adds a region correction value delivered from the horizontal synchronizing emulator 16*a* to the count of a counter 52*a* and outputs the result of addition to each of comparators 55*a* and 56*a*. The adder 61*b* adds a region correction value sent from the vertical synchronizing emulator 16*b* to the count of a counter 52*b* and outputs the result of addition to each of comparators 55*b* and 56*b*.

Other elements of structure employed in the second embodiment are identical to those employed in the first embodiment. The same elements of structure as those employed in the first embodiment are identified by like reference numerals and their detailed description will therefore be omitted.

Second Embodiment

Figure 12:
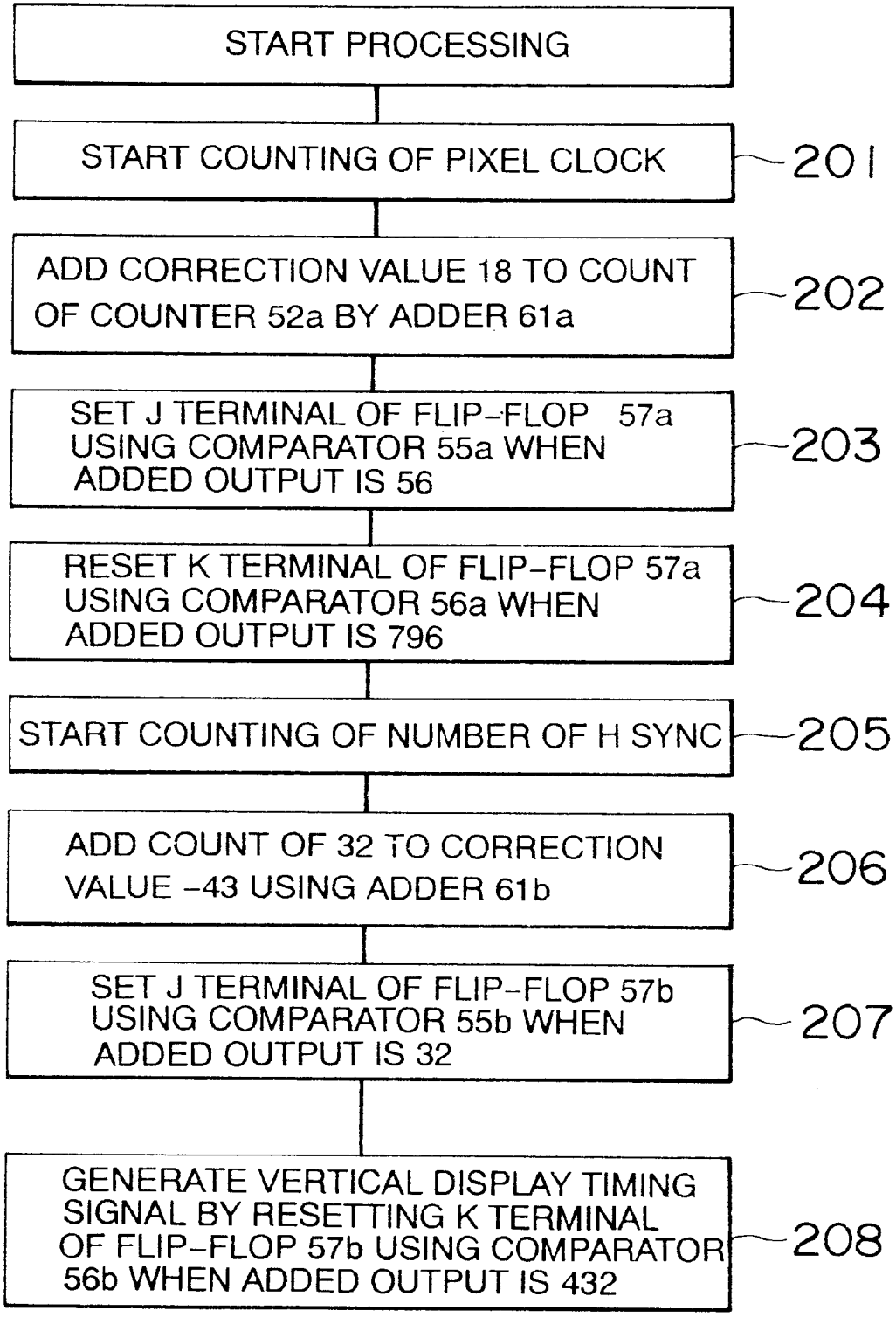
FIG. 12 is a flowchart for describing the operation of a display timing generator used for the execution of the method according to the second embodiment of the present invention.

FIG. 12 is a flowchart for describing the operation of each display timing generating device employed in the second embodiment. The counter 52*a* starts to count an input clock or the number of clock pulses of a pixel signal (Step 201). The horizontal synchronizing emulator 16*a* selects a correction value 18 for the low-resolution screen mode, for example.

Next, the adder 61*a* adds the correction value 18 to the count of the counter 52*a* (Step 202). When the count reaches 138, the added output of the adder 61*a* is brought to 156. At this time, the added output of the adder 61*a* reaches horizontal display start-position information 156 for the low-resolution screen mode, which has been stored in a display start-position register 53*a*, and the comparator 55*a* sets a J terminal of a flip-flop 57*a* (Step 203).

When, on the other hand, the count of the counter 52*a* reaches horizontal display end-position information 778 for the low-resolution screen mode, the output of the adder 61*a* is brought to 796. At this time, the added output reaches horizontal display end-position information 796 for the low-resolution screen mode, which has been stored in a display end-position register 54*a*, and the comparator 56*a* resets a K terminal of the flip-flop 57*a*. As a result, the flip-flop 57*a* produces a horizontal display timing signal (Step 204).

Next, the counter 52*b* starts to count the number of clock pulses of H-SYNC (Step 205). When the count of the counter 52*b* reaches 75, the adder 61*b* adds together the count 75 and a correction value −43 produced from the vertical synchronizing emulator 16*b* (Step 206).

The added output 32 reaches vertical display start-position information 32 for the low-resolution screen mode, which has been stored in the display start-position register 53*b* and the comparator 55*b* sets a J terminal of a flip-flop 57*b* (Step 207).

Next, when the count reaches 475, the added output is brought to 432. At this time, the added output reaches vertical display end-position information 432 for the low-resolution screen mode, which has been stored in a display end-position register 54*b* and the comparator 56*b* resets a K terminal of the flip-flop 57*b*. As a result, the flip-flop 57*b* produces a vertical display timing signal (Step 208).

The present embodiment can also bring about the same effect as that obtained in the first embodiment.

Third Embodiment

Figure 13:
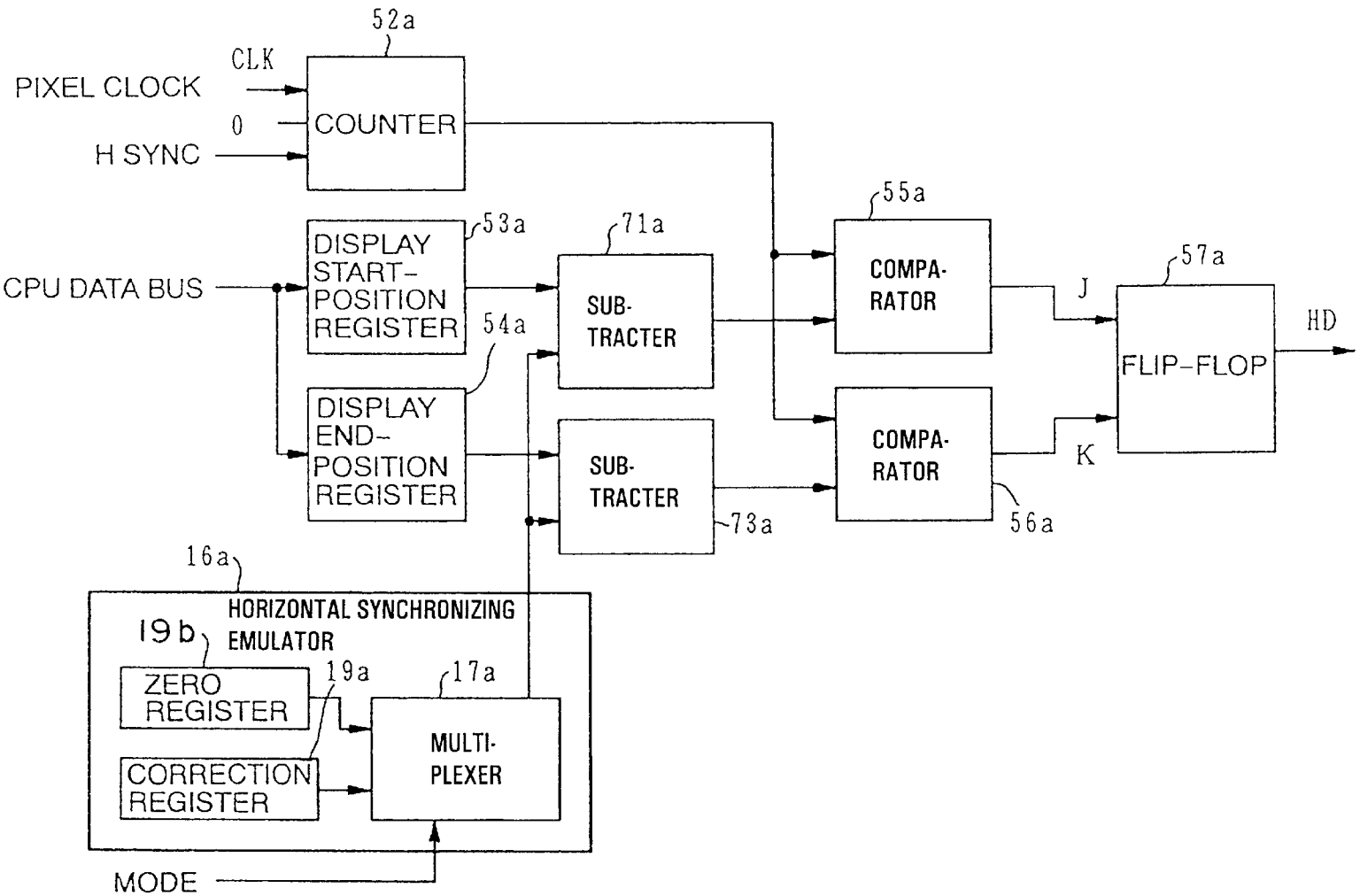
FIG. 13 is a block diagram illustrating a horizontal synchronizing emulator and a horizontal display timing generating device both employed in a third embodiment of the present invention.
Figure 14:
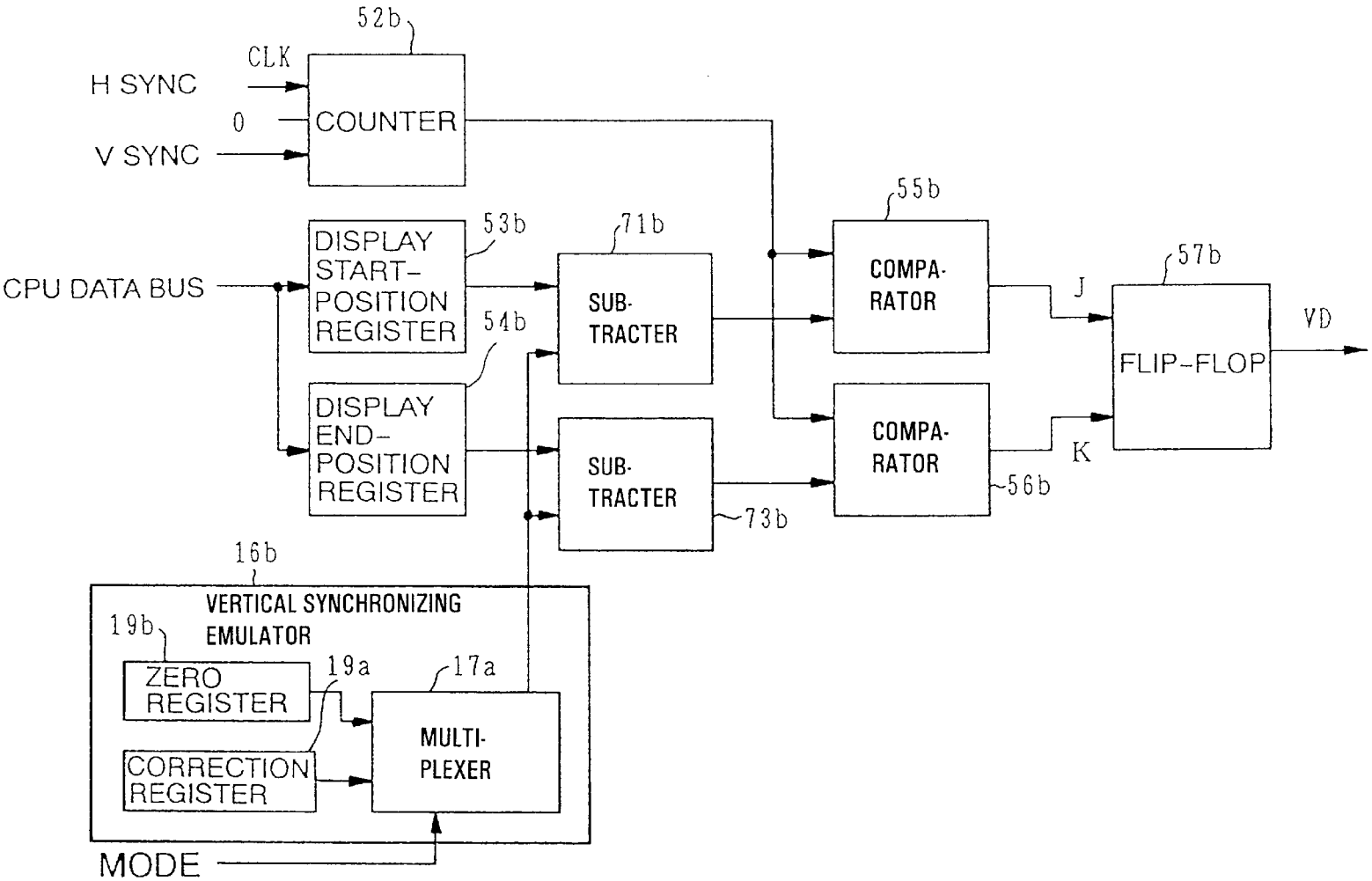
FIG. 14 is a block diagram showing a vertical synchronizing emulator and a vertical display timing generating device both employed in the third embodiment of the present invention.

A description will next be made of the third embodiment of the present invention. The third embodiment differs from the second embodiment in that each display timing generator is different in structure from that employed in the second embodiment. FIG. 13 is a block diagram showing a horizontal synchronizing emulator and a horizontal display timing generating device both employed in the third embodiment. FIG. 14 is a block diagram illustrating a vertical synchronizing emulator and a vertical display timing generating device both employed in the third embodiment. The display timing generating devices have subtracters 71*a* and 73*a*, and 71*b* and 73 respectively.

The subtracter 71*a* subtracts a region correction value produced from the horizontal synchronizing emulator 16*a* from display start-position information stored in a display start-position register 53*a* and outputs the result of subtraction to a comparator 55*a*. The subtracter 73*a* subtracts the region correction value produced from the horizontal synchronizing emulator 16*a* from display start-position information stored in a display start-position register 54*a* and outputs the result of subtraction to a comparator 56*a*.

The subtracter 71*b* subtracts a region correction value produced from a vertical synchronizing emulator 16*b* from display start-position information stored in a display start-position register 53*b* and outputs the result of subtraction to a comparator 55*b*. The subtracter 73*b* subtracts the region correction value of the vertical synchronizing emulator 16*b* from display start-position information stored in a display start-position register 54*b* and outputs the result of subtraction to a comparator 56*b*.

Other elements of structure employed in the third embodiment are identical to those employed in the second embodiment. The same elements of structure as those employed in the second embodiment are identified by like reference numerals and their detailed description will therefore be omitted.

Third Embodiment

Figure 15:
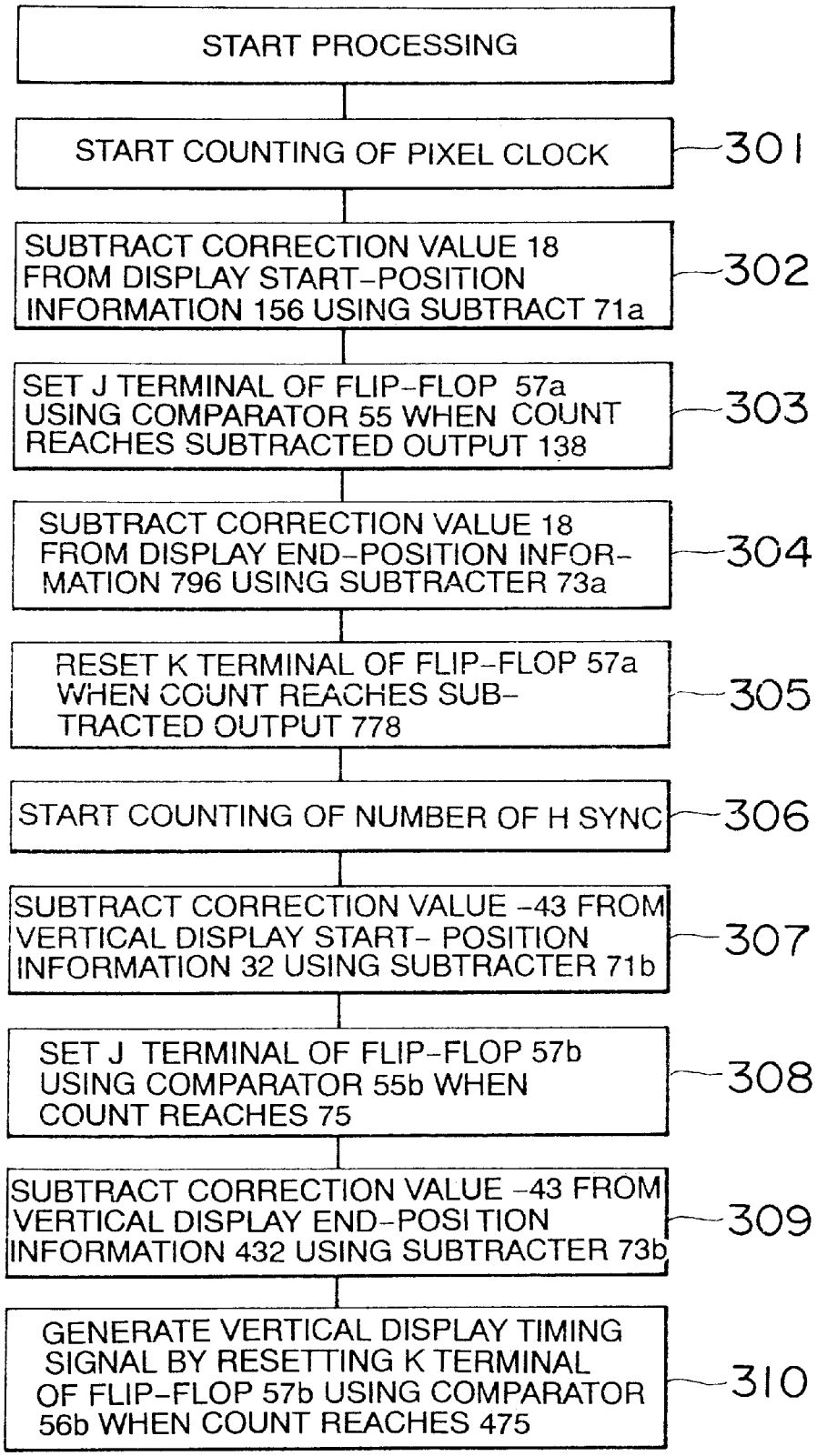
FIG. 15 is a flowchart for describing the operation of a display timing generator employed in the third embodiment of the present invention.

FIG. 15 is a flowchart for describing the operation of each display timing generator employed in the third embodiment. A counter 52*a* starts to count an input clock or the number of clock pulses of a pixel signal (Step 301). The horizontal synchronizing emulator 16*a* selects a correction value 18 for the low-resolution screen mode, for example.

Next, the subtracter 71*a* subtracts a correction value 18 from display start-position information 156 stored in the display start-position register 53*a* (Step 302) thereby to produce a subtracted output corresponding to 138. When the count of the counter 52*a* reaches the subtracted output 138, the comparator 55*a* sets a J terminal of a flip-flop 57*a* (Step 303).

Further, the subtracter 73*a* subtracts the correction value 18 from display end-position information 796 stored in the display end-position register 54*a* (Step 304) thereby to produce a subtracted output corresponding to 778. When the count of the counter 52*a* reaches the subtracted output 778, the comparator 56*a* resets a K terminal of the flip-flop 57*a*. As a result, the flip-flop 57*a* generates a horizontal display timing signal (Step 305).

The counter 52*b* then starts to count the number of clock pulses of H-SYNC (Step 306). Thereafter, the subtracter 71*b* subtracts a correction value −43 produced out of the vertical synchronizing emulator 16*b* from vertical display start-position information 32 stored in the display start-position register 53*b* thereby to produce a subtracted output corresponding to 75 (Step 307).

When the count of the counter 52*b* takes 75, the comparator 55*b* sets a J terminal of a flip-flop 57*b* (Step 308).

Next, the subtracter 73*b* subtracts the correction value −43 of the vertical synchronizing emulator 16*b* from vertical display end-position information 43 stored in the display end-position register 54*b* (Step 309) thereby to produce a subtracted output corresponding to 475. When the count of the counter 52*b* assumes 475, the comparator 56*b* resets a K terminal of the flip-flop 57*b*. As a result, the flip-flop 57*b* generates a vertical display timing signal (Step 310).

The third embodiment referred to above can also bring about the same effect as that obtained in the second embodiment.

Having now fully described the invention, it will be apparent to those skilled in the art that many changes and modifications can be made without departing from the spirit or scope of the invention as set forth herein.

What is claimed is:

1. A method of displaying one screen mode selected from a plurality of screen modes comprising the steps of:

generating a synchronizing signal for one screen mode selected from a plurality of screen modes, wherein said synchronizing signal is the same for each screen mode;

determining region correction values to display an image display region for said one screen mode, thereby to effect an image display region correction based on the region correction values;

generating a display region signal for the image display region corresponding to said one screen mode, based on said region correction values and said synchronizing signal for said one screen mode; and displaying said one screen mode based on said synchronizing signal and said display region signal.

2. A method according to claim 1, further comprising a step for generating a pixel signal for each of pixels which form the image display region for said one screen mode and wherein said display region signal generating step is executed to generate a display region signal for the image display region corresponding to said one screen mode based on said region correction values, said synchronizing signal for said one screen mode and said pixel signal.

3. A method according to claim 1, wherein said synchronizing signal generating step includes a step for counting the number of pulses of a clock corresponding to each pixel signal, a step for comparing the count of said number of clock pulses with each of a predetermined synchronizing width and a predetermined synchronizing cycle and a step for generating the synchronizing signal based on the result of comparison.

4. A method according to claim 1, wherein said display region correcting step includes a step for setting said one screen mode selected from a plurality of screen modes, a step for storing therein the region correction values for each screen mode, and a step for selecting a region correction value corresponding to the set screen mode from said stored region correction values.

5. A method according to claim 4, wherein said correction value storing step is executed to store, as the region correction values, a difference between display start and end positions for displaying the image display region for said one screen mode and a difference between display start and end positions for displaying the image display region for said any one of screen modes.

6. A method according to claim 1, wherein said display region signal generating step includes a step for starting the counting of the number of pulses of a clock corresponding to each pixel signal from the region correction values, a step for comparing the count of said number of clock pulses with each of display start-position information and display end-position information for displaying the image display region for said one screen mode and a step for generating the display region signal based on the output obtained by said comparison.

7. A method according to claim 1, wherein said display region signal generating step includes a step for starting the counting of the number of pulses of a clock corresponding to each pixel signal, a step for adding each of the region correction values to the count of said number of clock pulses, a step for comparing the output obtained by said addition with each of the display start-position information and the display end-position information for displaying the image display region for said one screen mode, and a step for generating the display region signal based on the output obtained by said comparison.

8. A method according to claim 1, wherein said display region signal generating step includes a step for starting the counting of the number of pulses of a clock corresponding to each pixel signal, a step for subtracting each of the region correction values from each of the display start-position information and the display end-position information for displaying the image display region for said any one of screen modes, a step for comparing the output obtained by said subtraction with the count of said number of clock pulses and a step for generating the display region signal based on the output obtained by said comparison.

9. A method according to claim 1, wherein said one screen mode represents a high-resolution screen mode and each of plural screen modes other than said one screen mode represents a low-resolution screen mode.

10. An apparatus for displaying one screen mode selected from a plurality of screen modes, comprising:

synchronizing signal generating means for generating a synchronizing signal for said one screen mode selected from plurality of screen modes, wherein said synchronizing signal is the same for each screen mode;

display region correcting means for setting region correction values to display an image display region for said one screen mode;

display region signal generating means for generating a display region signal for the image display region corresponding to said one screen mode based on said region correction values and said synchronizing signal for said one screen mode; and displaying means for displaying said one screen mode based on said synchronizing signal and said display region signal.

11. An apparatus according to claim 10, further comprising pixel signal generating means for generating a pixel signal for each of pixels which form the image display region for said first screen mode and wherein said display region signal generating means generates a display region signal for the image display region corresponding to said one screen mode based on said region correction values, said synchronizing signal for said first screen mode and said pixel signal.

12. An apparatus according to claim 10, wherein said synchronizing signal generating means includes counting means for counting the number of pulses of a clock corresponding to each pixel signal, comparing means for comparing the count of said counting means with each of a predetermined synchronizing width and a predetermined synchronizing cycle and signal generating means for generating the synchronizing signal based on the output of said comparing means.

13. An apparatus according to claim 10, wherein said display region correcting means includes screen mode setting means for setting said said first screen mode or second screen mode, correction value storing means for storing therein the region correction values each screen mode and correction value selecting means for selecting a region correction value corresponding to the screen mode set by said screen mode setting means from said region correction values stored in said correction value storing means.

14. An apparatus according to claim 13, wherein said correction value storing means stores, as the region correction values, a difference between display start and end positions for displaying the image display region for said first screen mode and a difference between display start and end positions for displaying the image display region for said second screen mode.

15. An apparatus according to claim 10, wherein said display region signal generating means includes counting means for starting the counting of the number of pulses of a clock corresponding to each pixel signal from the region correction values, comparing means for comparing the count of said counting means with each of display start-position information and display end-position information for displaying the image display region for said first screen mode and signal generating means for generating the display region signal based on the output of said comparing means.

16. An apparatus according to claim 10, wherein said display region signal generating means includes counting means for starting the counting of the number of pulses of a clock corresponding to each pixel signal, adding means for adding each of the region correction values produced from said display region correcting means to the count of said counting means, comparing means for comparing the output of said adding means with each of the display start-position information and the display end-position information for displaying the image display region for said first screen mode, and signal generating means for generating the display region signal based on the output of said comparing means.

17. An apparatus according to claim 10, wherein said display region signal generating means includes counting means for starting the counting of the number of pulses of a clock corresponding to each pixel signal, subtracting means for subtracting each of the region correction values from each of the display start-position information and the display end-position information for displaying the image display region for said any one of screen modes, comparing means for comparing the output of said subtracting means with the count of said counting means, and signal generating means for generating the display region signal based on the output of said comparing means.

18. An apparatus according to claim 10, wherein said first screen mode represents a high-resolution screen mode and said second screen mode represents a low-resolution screen mode.

19. An apparatus for displaying a screen mode having at least a first screen mode based on a first synchronizing signal and a second screen mode based on a second synchronizing signal, comprising:

synchronizing signal generating means for generating said first or said second synchronizing signal, said first synchronizing signal being the same as said second synchronizing signal;

display region correcting means for determining region correction values to display the first or second screen mode within an image display region of the first or second screen mode;

display region signal generating means for generating a display region signal for the image display region corresponding to said first or second screen mode, based on said determined region correction values and said first or second synchronizing signal for said first or second screen mode; and display means for displaying said first or second screen mode within said first or second screen mode based on said first or second synchronizing signal and said display region signal.

20. A method of displaying one screen mode selected from a plurality of screen modes comprising the steps of:

generating a synchronizing signal for one screen mode selected from a plurality of screen modes, said synchronizing signal being the same for each of the plurality of screen modes;

determining region correction values to display an image display region for said one screen mode selected from a plurality of screen modes, thereby to effect an image display region correction based on the region correction values;

generating a display region signal for the image display region corresponding to said one screen mode, based on said region correction values and said synchronizing signal for said one screen mode; and displaying said one screen mode based on said synchronizing signal and said display region signal, wherein image data is displayed in said one screen mode having image display regions different from each other.

21. A method according to claim 20, further comprising a step for generating a pixel signal for each of pixels which form the image display region for said one screen mode and wherein said display region signal generating step is executed to generate a display region signal for the image display region corresponding to said any one of screen modes, based on said region correction values, said synchronizing signal for said one screen mode and said pixel signal.

22. A method according to claim 20, wherein said synchronizing signal generating step includes a step for counting the number of pulses of a clock corresponding to each pixel signal, a step for comparing the count of said number of clock pulses with each of a predetermined synchronizing width and a predetermined synchronizing cycle and a step for generating the synchronizing signal based on the result of comparison.

23. A method according to claim 20, wherein said display region correcting step includes a step for setting said any one of screen modes including said one screen mode, a step for storing therein the region correction values for each screen mode and a step for selecting a region correction value corresponding to the set screen mode from said stored region correction values.

24. A method according to claim 23, wherein said correction value storing step is executed to store, as the region correction values, a difference between display start and end positions for displaying the image display region for said one screen mode and a difference between display start and end positions for displaying the image display region for said any one of screen modes.

25. A method according to claim 20, wherein said display region signal generating step includes a step for starting the counting of the number of pulses of a clock corresponding to each pixel signal from the region correction values, a step for comparing the count of said number of clock pulses with each of display start-position information and display end-position information for displaying the image display region for said one screen mode and a step for generating the display region signal based on the output obtained by said comparisons.

26. A method according to claim 20, wherein said display region signal generating step includes a step for starting the counting of the number of pulses of a clock corresponding to each pixel signal, a step for adding each of the region correction values to the count of said number of clock pulses, a step for comparing the output obtained by said addition with each of the display start-position information and the display end-position information for displaying the image display region for said one screen mode, and a step for generating the display region signal based on the output obtained by said comparison.

27. A method according to claim 20, wherein said display region signal generating step includes a step for starting the counting of the number of pulses of a clock corresponding to each pixel signal, a step for subtracting each of the region correction values from each of the display start-position information and the display end-position information for displaying the image display region for said any one of screen modes, a step for comparing the output obtained by said subtraction with the count of said number of clock pulses and a step for generating the display region signal based on the output obtained by said comparison.

28. A method according to claim 20, wherein said one screen mode represents a high-resolution screen mode and each of plural screen modes other than one screen mode represents a low-resolution screen mode.

29. An apparatus for displaying one screen mode selected from a plurality of screen modes, comprising:

synchronizing signal generating means for generating a synchronizing signal for a first screen mode, said synchronizing signal being the same for each of the plurality of screen modes;

display region correcting means for setting region correction values to display an image display region for said one screen mode;

display region signal generating means for generating a display region signal for the image display region corresponding to said one screen mode based on said region correction values and said synchronizing signal for said first screen mode; and displaying means for displaying said one screen mode based on said synchronizing signal and said display region signal, wherein image data is displayed in any one of the screen modes having image display regions different from each other.

30. An apparatus according to claim 29, further comprising pixel signal generating means for generating a pixel signal for each of pixels which form the image display region for said first screen mode and wherein said display region signal generating means generates a display region signal for the image display region corresponding to said any one of screen modes based on said region correction values, said synchronizing signal for said first screen mode and said pixel signal.

31. An apparatus according to claim 29, wherein said synchronizing signal generating means includes counting means for counting the number of pulses of a clock corresponding to each pixel signal, comparing means for comparing the count of said counting means with each of a predetermined synchronizing width and a predetermined synchronizing cycle and signal generating means for generating the synchronizing signal based on the output of said comparing means.

32. An apparatus according to claim 29, wherein said display region correcting means includes screen mode setting means for setting said first screen mode or second screen mode, correction value storing means for storing therein the region correction values each screen mode and correction value selecting means for selecting a region correction value corresponding to the screen mode set by said screen mode setting means from said region correction values stored in said correction value storing means.

33. An apparatus according to claim 32, wherein said correction value storing means stores, as the region correction values, a difference between display start and end positions for displaying the image display region for said first screen mode and a difference between display start and end positions for displaying the image display region for said second screen mode.

34. An apparatus according to claim 29, wherein said display region signal generating means includes counting means for starting the counting of the number of pulses of a clock corresponding to each pixel signal from the region correction values, comparing means for comparing the count of said counting means with each of display start-position information and display end-position information for displaying the image display region for said first screen mode and signal generating means for generating the display region signal based on the output of said comparing means.

35. An apparatus according to claim 29, wherein said display region signal generating means includes counting means for starting the counting of the number of pulses of a clock corresponding to each pixel signal, adding means for adding each of the region correction values produced from said display region correcting means to the count of said counting means, comparing means for comparing the output of said adding means with each of the display start-position information and the display end-position information for displaying the image display region for said first screen mode, and signal generating means for generating the display region signal based on the output of said comparing means.

36. An apparatus according to claim 29, wherein said display region signal generating means includes counting means for starting the counting of the number of pulses of a clock corresponding to each pixel signal, subtracting means for subtracting each of the region correction values from each of the display start-position information and the display end-position information for displaying the image display region for said any one of screen modes, comparing means for comparing the output of said subtracting means with the count of said counting means, and signal generating means for generating the display region signal based on the output of said comparing means.

37. An apparatus according to claim 29, wherein said first screen mode represents a high-resolution screen mode and said second screen mode represents a low-resolution screen mode.

38. An apparatus for displaying screen modes having at least a first screen mode based on a first synchronizing signal and a second screen mode based on a second synchronizing signal, comprising:

synchronizing signal generating means for generating said first synchronizing signal for said first screen mode, said first synchronizing signal being the same as said second synchronizing signal;

display region correcting means for determining region correction values to display said first or second screen mode within an image display region of said first screen mode;

display region signal generating means for generating a display region signal for the image display region corresponding to said first or second screen modes, based on said determined region correction values and said first synchronizing signal for said first screen mode; and displaying means for displaying said first or second screen mode based on said first synchronizing signal and said display region signal, wherein image data is displayed in said first or second screen modes having image display regions different from each other.

39. A method of displaying one screen mode selected from a plurality of screen modes comprising the steps of:

generating a synchronizing signal for one screen mode, wherein the synchronizing signal has a constant cycle and width, said synchronizing signal being the same for each of the plurality of screen modes;

determining region correction values to display an image display region said one screen mode, thereby to effect an image display region correction based on the region correction values;

generating a display region signal, set by software, for the image display region corresponding to said one screen mode, based on said region correction values and said synchronizing signal for said one screen mode; and displaying said one screen mode selected from a plurality of screen modes on the screen based on said synchronizing signal and said display region signal, wherein image data can be displayed in said one screen mode having image display regions different from each other.

40. An apparatus for displaying one screen mode selected from a plurality of screen modes, comprising:

synchronizing signal generating means, having a constant width and a constant cycle, for generating a synchronizing signal for said one screen mode, said synchronizing signal being the same for each of the plurality of screen modes;

display region correcting means for setting region correction values to display an image display region for said one screen mode selected from plurality of screen modes;

display region signal generating means for generating a display region signal, set by software, for the image display region corresponding to said one screen mode based on said region correction values and said synchronizing signal for said one screen mode; and displaying means for displaying said one screen mode selected from a plurality of screen modes based on said synchronizing signal and said display region signal, wherein image data can be displayed in one screen mode having image display regions different from each other.

41. A method of controlling of displaying one screen mode selected from a plurality of screen modes comprising the steps of:

generating a synchronizing signal for one screen mode selected from a plurality of screen modes, wherein said synchronizing signal is the same for each screen mode;

determining region correction values to display an image display region for said one screen mode, thereby to effect an image display region correction based on the region correction values; and generating a display region signal for the image display region corresponding to said one screen mode, based on said region correction values and said synchronizing signal for said one screen mode.

42. An apparatus for controlling of displaying one screen mode selected from a plurality of screen modes, comprising:

a synchronizing signal generating unit generating a synchronizing signal for said one screen mode selected from plurality of screen modes, wherein said synchronizing signal is the same for each screen mode;

a display region correcting unit setting region correction values to display an image display region for said one screen mode; and a display region signal generating unit generating a display region signal for the image display region corresponding to said one screen mode based on said region correction values and said synchronizing signal for said one screen mode.

43. An apparatus for controlling of displaying a screen mode having at least a first screen mode based on a first synchronizing signal and a second screen mode based on a second synchronizing signal, comprising:

a synchronizing signal generating unit generating said first or said second synchronizing signal, said first synchronizing signal being the same as said second synchronizing signal;

a display region correcting unit determining region correction values to display the first or second screen mode within an image display region of the first or second screen mode;

a display region signal generating unit generating a display region signal for the image display region corresponding to said first or second screen mode, based on said determined region correction values and said first or second synchronizing signal for said first or second screen mode; and a display control unit controlling of displaying said first or second screen mode within said first or second screen mode based on said first or second synchronizing signal and said display region signal.

44. A method of controlling of displaying one screen mode selected from a plurality of screen modes comprising the steps of:

generating a synchronizing signal for one screen mode selected from a plurality of screen modes, said synchronizing signal being the same for each of the plurality of screen modes;

determining region correction values to display an image display region for said one screen mode selected from a plurality of screen modes, thereby to effect an image display region correction based on the region correction values;

generating a display region signal for the image display region corresponding to said one screen mode, based on said region correction values and said synchronizing signal for said one screen mode; and controlling displaying of said one screen mode based on said synchronizing signal and said display region signal, wherein image data is displayed in said one screen mode having image display regions different from each other.

45. An apparatus for controlling of displaying one screen mode selected from a plurality of screen modes, comprising:

a synchronizing signal generating unit generating a synchronizing signal for a first screen mode, said synchronizing signal being the same for each of the plurality of screen modes;

a display region correcting unit setting region correction values to display an image display region for said one screen mode;

a display region signal generating unit generating a display region signal for the image display region corresponding to said one screen mode based on said region correction values and said synchronizing signal for said first screen mode; and a display controlling unit controlling display of said one screen mode based on said synchronizing signal and said display region signal, wherein image data is displayed in any one of the screen modes having image display regions different from each other.

46. An apparatus for controlling of displaying screen modes having at least a first screen mode based on a first synchronizing signal and a second screen mode based on a second synchronizing signal, comprising:

a synchronizing signal generating unit generating said first synchronizing signal for said first screen mode, said first synchronizing signal being the same as said second synchronizing signal;

a display region correcting unit determining region correction values to display said first or second screen mode within an image display region of said first screen mode;

a display region signal generating unit generating a display region signal for the image display region corresponding to said first or second screen modes, based on said determined region correction values and said first synchronizing signal for said first screen mode; and a display controlling unit controlling displaying of said first or second screen mode based on said first synchronizing signal and said display region signal, wherein image data is displayed in said first or second screen modes having image display regions different from each other.

47. A method of displaying one screen mode selected from a plurality of screen modes comprising the steps of:

generating a synchronizing signal for one screen mode, wherein the synchronizing signal has a constant cycle and width, said synchronizing signal being the same for each of the plurality of screen modes;

determining region correction values to display an image display region said one screen mode, thereby to effect an image display region correction based on the region correction values;

generating a display region signal, set by software, for the image display region corresponding to said one screen mode, based on said region correction values and said synchronizing signal for said one screen mode; and controlling displaying of said one screen mode selected from a plurality of screen modes on the screen based on said synchronizing signal and said display region signal, wherein image data can be displayed in said one screen mode having image display regions different from each other.

48. An apparatus for controlling of displaying one screen mode selected from a plurality of screen modes, comprising:

a synchronizing signal generating unit, having a constant width and a constant cycle, for generating a synchronizing signal for said one screen mode, said synchronizing signal being the same for each of the plurality of screen modes;

a display region correcting unit setting region correction values to display an image display region for said one screen mode selected from plurality of screen modes;

a display region signal generating unit generating a display region signal, set by software, for the image display region corresponding to said one screen mode based on said region correction values and said synchronizing signal for said one screen mode; and a controlling unit controlling displaying of said one screen mode selected from a plurality of screen modes based on said synchronizing signal and said display region signal, wherein image data can be displayed in one screen mode having image display regions different from each other.

* * * * *